United States Patent [19]

Clavin

[11] 4,164,135

[45] Aug. 14, 1979

[54] ROTARY INTERNAL PIPE BENDING MANDREL

[75] Inventor: Edward A. Clavin, Houston, Tex.

[73] Assignee: Midcon Pipeline Equipment Co., Houston, Tex.

[21] Appl. No.: 856,850

[22] Filed: Dec. 2, 1977

[51] Int. Cl.[2] ..... B21D 9/00

[52] U.S. Cl. ..... 72/466; 269/48.1

[58] Field of Search ..... 72/392, 393, 466; 269/48.1

[56] References Cited

U.S. PATENT DOCUMENTS

| | | | |
|---|---|---|---|
| 3,109,477 | 11/1963 | Avera et al. | 269/48.1 |
| 3,220,719 | 11/1965 | Luker | 269/48.1 |
| 3,644,977 | 2/1972 | Valentine | 269/48.1 |
| 3,741,457 | 6/1973 | Gwin et al. | 269/48.1 |

*Primary Examiner*—Lowell A. Larson
*Attorney, Agent, or Firm*—Carl B. Fox, Jr.

[57] ABSTRACT

Rotary internal pipe bending mandrel, wherein sets of pipe engagement elements at opposite sides of the pipe interior are actuated by generally radially disposed toggle elements which expand and retract the pipe engagement elements by rotations of a central assembly. The elements which support the pipe engagement elements are disposed in circularly spaced groups which are axially spaced along the direction of the pipe, and each group is separately expanded by a separate fluid motor assembly. The apparatus has improved the load bearing characteristics because it has positive end engagements of the toggles, whereby the pins or shafts on which the toggles are pivotally mounted are not excessively strained.

14 Claims, 8 Drawing Figures

ROTARY INTERNAL PIPE BENDING MANDREL

BACKGROUND OF THE INVENTION

Internal pipe bending mandrels are mandrels which are employed within pipes to support the walls of the pipe during bending of the pipe. Such mandrels may be retracted for movement through a pipe and expanded during pipe bending to support the pipe wall at the inner and outer bending radii, so that the pipe will not be distorted during bending. Internal pipe bending mandrels of several types are shown in U.S. Pat. Nos. 3,274,817, 3,747,394, 3,851,519, and 3,964,290. Other forms of internal pipe bending mandrels are shown in U.S. Pat. Nos. 3,109,477, 3,602,031, and 3,043,361.

Internal pipe bending mandrels must exert very high forces on the pipe wall in order to properly support the pipe wall during bending. Pipe used in construction of petroleum pipe lines may be as large as sixty inches in diameter, and the wall thicknesses may be as much as three-fourths inch, or even more. With pipe of large diameter and wall thickness, the bending forces are very high. The apparatuses known in the art, in general, have not been of sufficient force capacity to adequately protect the pipe walls during bending, and in addition have been excessively complicated, heavy, and expensive. The present invention avoids many of the problems encountered with the prior art apparatuses, by increasing the force capacity of internal pipe bending mandrels, and by reducing weight and cost of such apparatuses.

SUMMARY OF THE INVENTION

The invention presents internal rotary pipe bending mandrels of improved design, which are capable of exerting and withstanding the high loads encountered during bending of pipe, and which are of reduced weight and cost. Plural radially disposed expandable-retractable slide elements carry pipe engaging members at their outer ends. The expandable-retractable elements are expanded and retracted by toggles which are disposed in planes transverse to the pipe axis and which are disposed generally radially of the pipe when extended, and which are actuated to expand or retract the slide elements by a rotative drive assembly at the inner ends of the toggles. Each group of slide elements includes elements for applying force interiorly of the pipe at the inner side of the bend and at the outer side of the bend. Each group of expandable-retractable elements is separately driven to expand or retract by fluid motor devices associated with that group of expandable-retractable elements. Plural groups of expandable-retractable elements, each separately powered, are assembled to make a complete mandrel. The toggles are disposed so that the outward forces applied therethrough are borne by the ends of the toggles whereby the pins or shafts which mount the toggles are not subjected to the high pipe bending forces. In prior apparatuses, which used toggles pivotally movable in the direction of the pipe axis, the bending forces in virtually all of such apparatuses were borne by the pins or shafts mounting the toggles, and this structure has resulted in load capacity limitations of the apparatuses.

A principal object of the invention is to provide internal pipe bending mandrels of improved design. Another object of the invention is to provide such apparatuses which have high load exerting and high load bearing capacities, and which are relatively light in weight and inexpensive. Another object of the invention is to provide such apparatuses wherein the pipe engaging forces are exerted through radially disposed toggles driven by central rotary drive means. Still another object of the invention is to provide such apparatuses wherein the forces exerted by the mandrel may approach infinity.

Other objects and advantages of the invention will appear from the following detailed descriptions of preferred embodiments, reference being made to the accompanying drawings.

BRIEF DESCRIPTIONS OF THE DRAWINGS

Figure 3:
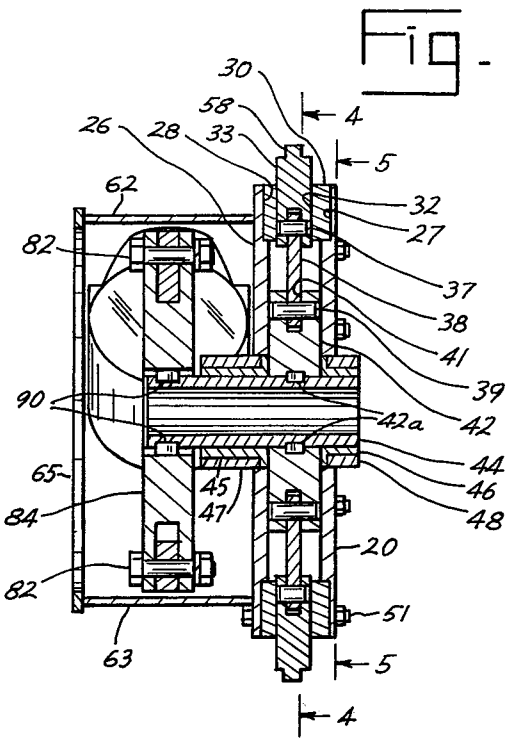
FIG. 3 is a vertical cross section taken at line 3—3 of FIG. 2.
Figure 5:
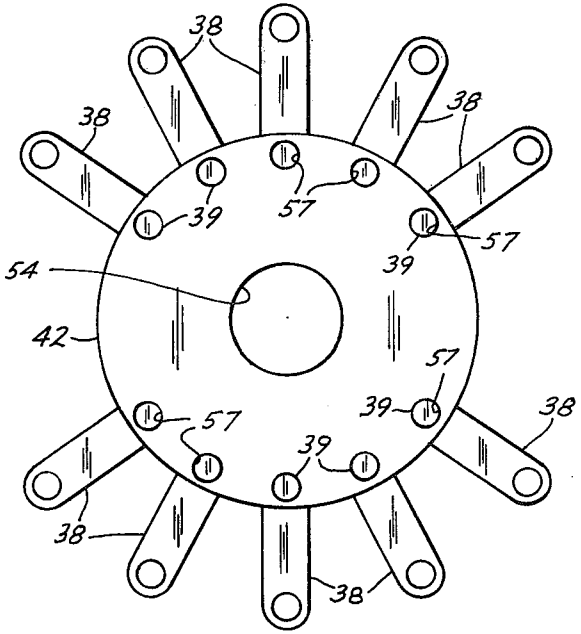
Figure 4:
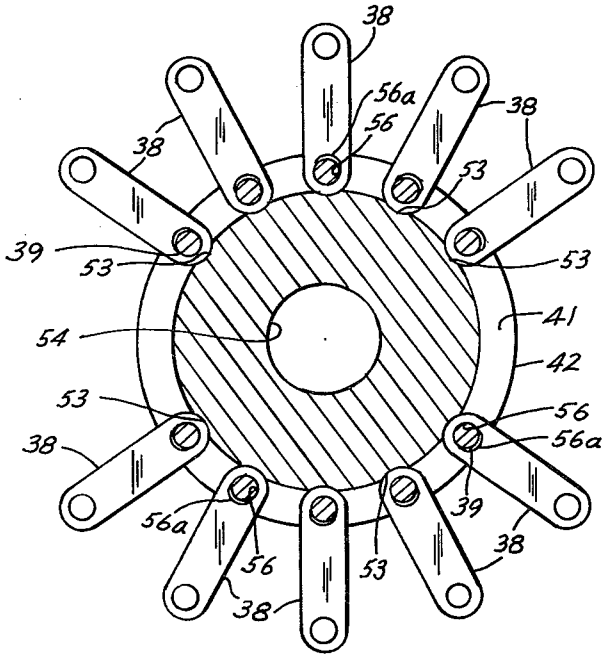

FIGS. 4 and 5 are, respectively, vertical transverse cross sections taken at line 4—4 of FIG. 3 and at line 5—5 of FIG. 3.

Figure 6:
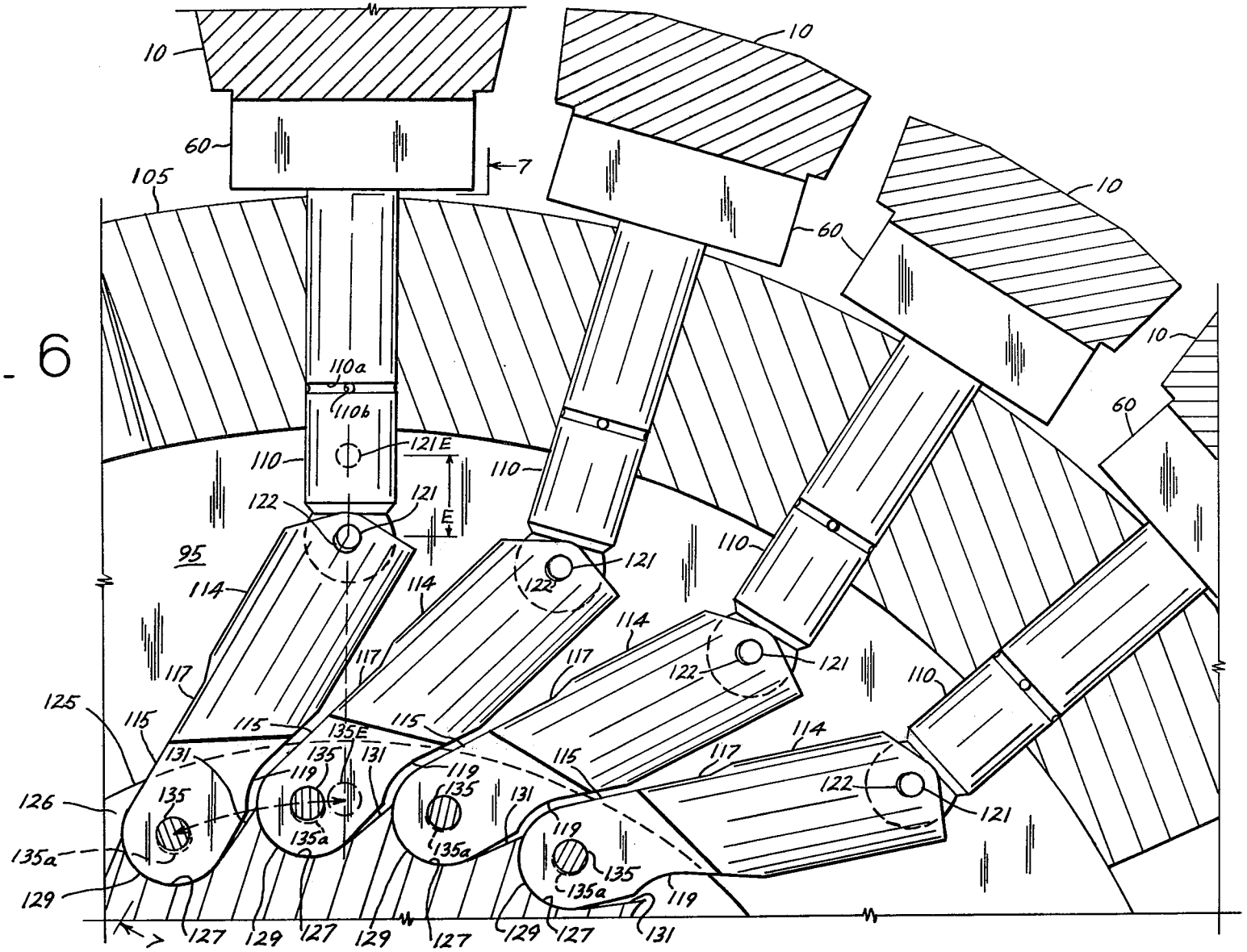

FIG. 6 is a partial enlarged vertical cross section showing a modification of the apparatus.

Figure 7:
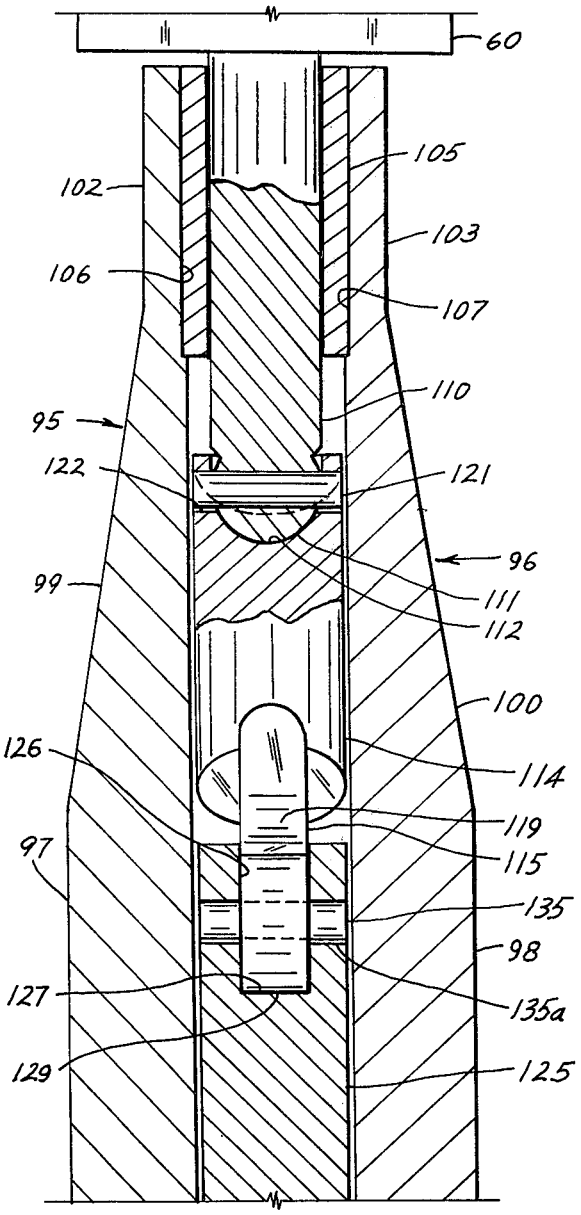

FIG. 7 is an enlarged cross section taken at line 7—7 of FIG. 6.

Figure 8:
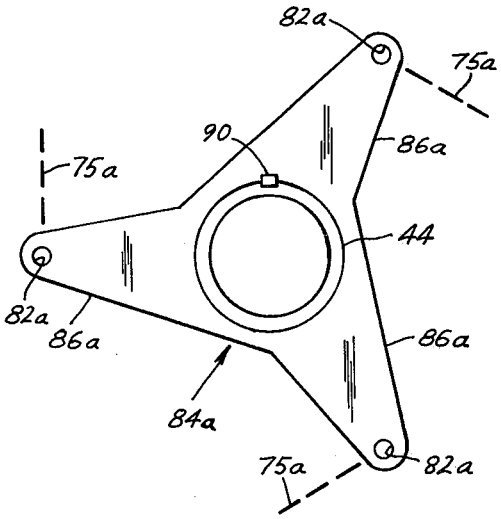

FIG. 8 is a partial elevation, partially schematic, showing a modification of the apparatus.

DESCRIPTIONS OF THE PREFERRED EMBODIMENTS

Figure 1:
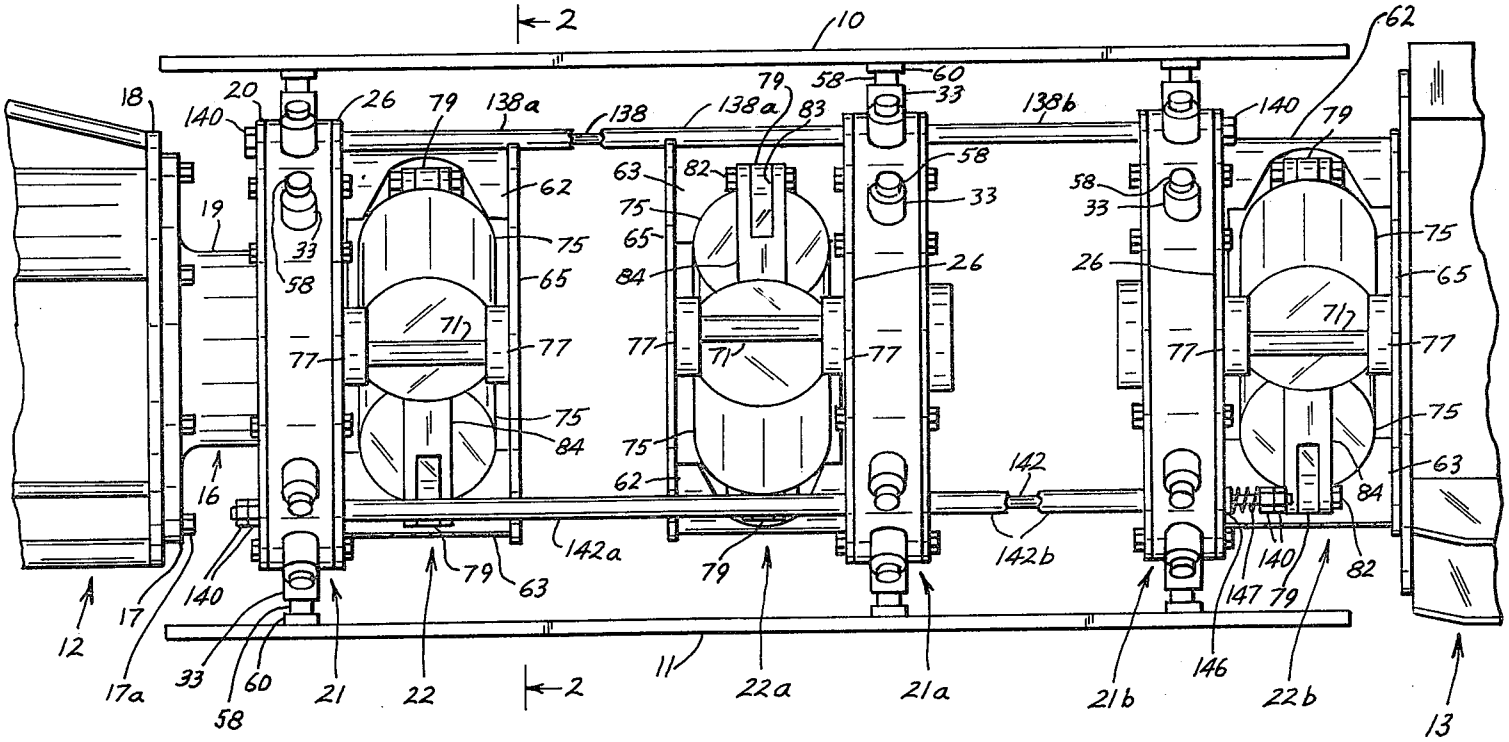
FIG. 1 is a side elevation of a preferred embodiment of apparatus according to the invention.

Referring now to the drawings in detail, and first to FIG. 1, the preferred embodiment of apparatus according to the invention which is shown in FIGS. 1–5 includes a plurality of upper pipe engaging elements 10 and a plurality of lower pipe engaging elements 11. Only one each of the elements 10 and 11 is shown in FIG. 1 of the drawings. A drive unit 12 supports the apparatus at its lefthand end as shown in FIG. 1, and a hydraulic unit 13 supports the apparatus at its righthand end. Drive unit 12 will include suitable wheels (not shown) for supporting the apparatus for rolling movement through a pipe and will include at least one drive wheel (not shown) for propelling the apparatus in such a movement. Hydraulic unit 13 includes wheels (not shown) for supporting the apparatus during movement of the apparatus through a pipe, and will usually include apparatus for supplying hydraulic or pneumatic fluids under pressure to the apparatus. Drive units and hydraulic units suitable for the purpose of this invention will readily be found in the art, in several forms.

An adapter assembly 16 including flange 17 bolted to end plate 18 of drive unit 12 by circularly spaced bolts 17*a* has intermediate portion 19 affixed to end plate 20 of expansion-retraction unit 21. Element 19 is tubular so that hydraulic lines or conduits (not shown) from hydraulic unit 13 may extend therethrough to operate a fluid motor of unit 12 to drive the driven wheels of unit 12.

A drive assembly 22 drives expansion-retraction unit 21. The apparatus includes two additional expansion-retraction assemblies 21*a*, 21*b* with which are associated respective drive assemblies 22*a* and 22*b*. Expansion-retraction assembly 21*a* and drive assembly 22*a* are in mirror image disposition as regards assemblies 21, 22 and 21*b*, 22*b*, but otherwise are the same. Only assemblies 21, 22 will be described in detail, and reference numerals applied thereto will be applied also to the same elements of the other assemblies.

Figure 2:
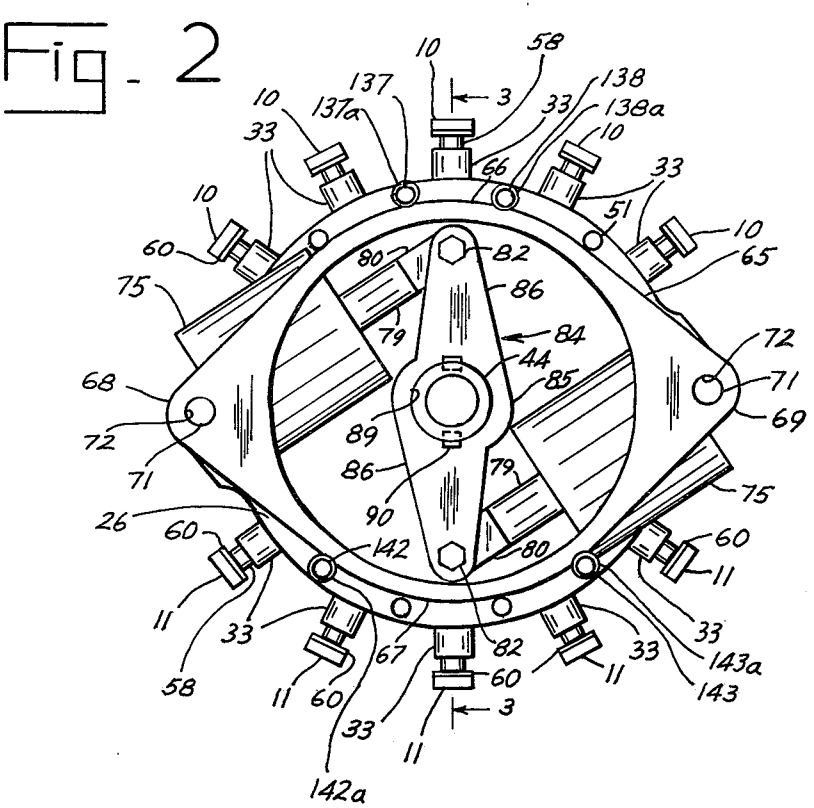
FIG. 2 is a vertical cross section taken at line 2—2 of FIG. 1.

The expansion-retraction assembly 21 includes plate 20, previously mentioned, and a plate 26 at the opposite side of the assembly. Referring now also to FIGS. 2 and 3 of the drawings, the plates 20, 26 are each recessed annularly around their peripheries at 27, 28, respectively. A circular ring 30 is disposed in the peripherial recesses 27, 28, as is best shown in FIG. 3. Ring 30 includes a plurality of radially disposed circularly spaced cylindrical passages or bores 32 in each of which is disposed a slide element 33 of cylindrical shape closely yet slidably fitted into the bore. The elements 33 and the bores in which they are received are spaced as indicated in FIG. 2. Five elements 33 are disposed at the upper side of the apparatus and are shown to be equally circularly spaced, but the circular spacing may be uneven if desired and any suitable number of elements 33 may be employed. Similarly, a group of five slide elements 33 is disposed circularly spaced at the lower side of the apparatus, each slide element 33 being disposed through a cylindrical opening or bore 32 of the ring 30. There are no elements 33 at the central side portions of the apparatus, since the forces required to be applied to a pipe during bending are at the top, at the inside of the pipe bend, and at the bottom, at the outside of the pipe bend. Each slide element 33, of both the upper and lower groups thereof, is connected by a cross pin 37 to the other end of a toggle element 38. The inner ends of the toggles 38 are connected by cross pins or shafts 39 into a slot 41 around the outer periphery of a large disc or hub 42. Disc 42 is keyed at 42*a* to a hollow shaft 44 which is journaled in sleeve-shaped bearing elements 45, 46 supported in sleeves 47, 58, respectively. Sleeve 48 is affixed to plate 20, while sleeve 47 is affixed to plate 26, as shown. The ring 30 is affixed between the plates 20, 26 by circularly spaced bolts 51 disposed through suitable holes through these elements.

In FIGS. 4 and 5, the toggle elements 38 and disc 42 are shown, in transverse cross section in FIG. 4 and in elevation in FIG. 5. In FIG. 4, the slot 41 is shown to have an arcuate recess or depression 53 at the location of each toggle 38, into which the inner end of the toggle is disposed. The purposes of these depressions will be made clear later on in the description. The pins 39 which connect the inner ends of the toggle elements to disc 42 extend completely through disc 42, passing through openings through the toggles within slot 41. Central circular opening or bore 54 through disc 42 receives the shaft 44 which, as explained earlier, is keyed thereto.

The holes 56 at the inner ends of the toggles 38 through which the pins 39 are disposed are not circular. These holes are semicircular at both ends and are elongated at their sides in the direction of the length of the toggle as indicated at 56*a*. Pins 39 are welded to disc 42 at their opposite ends within the holes 57 through the disc periphery at the opposite sides of slot 41. The pins 39, therefore, are stationary with respect to disc 42. The toggles rotate about pins 39 within an angular range of pivotal motion. The outwardly elongated shapes of the toggle holes 56 provide that when radial inward load is placed on the toggles 38, the toggles seat in recesses 53 against the solid metal of disc 42 at the bottom of slot 41 so that the toggle load is not imposed on the pins 39. For this reason, the load bearing capacity of the toggle-disc assembly is greatly increased. Were the load imposed on the pins 39, the strength of the pins would limit the load bearing capacity, but with the load taken by the disc itself, there is no give to the connections and very much higher toggle loads may be accommodated. Wear at the toggle ends and at recesses 53 may be compensated by shims at the pipe engagement elements 10, 11, to be further described.

At their outer ends, the slide elements 33 are reduced at 58, the reduced portions being of concentric cylindrical shape. Small rectangular plates 60 are affixed to the outer ends of slide elements 33 by bolts (not shown) the heads of which are received in counterbored openings (not shown) in the outer faces of plate 60 and the threaded shanks of which are screwed into tapped openings in the ends of reduced slide portions 58. This manner of connection is conventional in this type of apparatus and should not require further explanation for the skilled artisan. Elongate pipe wall engaging elements 10 and 11 are affixed to the plate elements 60 in conventional manner. The pipe engaging elements 10, 11, details of which are not shown, may consist of several layers, the inner layer usually being a support layer formed of steel and the outermost layer usually being of an elastomeric material, for example, a hard plastic material. These, too, are of conventional design and require no further explanation. To accommodate to variances in pipe diameter, or to different sizes of pipes, or for wear of the apparatus elements, spacers or shims may be incorporated in the pipe engaging assemblies to alter their effective diameters. This, too, is conventional in the art.

Each plate 26 is affixed by arcuate plates 62, 63 to a shaped plate 65, the plates having arcuate reliefs as necessary for clearance. Plate 65 is of ring shape at its upper and lower portions 66, 67 and has rounded extended portions 68, 69 at its opposite lateral sides. Each plate 26 has similar portions matching the contours of portions 68, 69 of the plates 65. Bars or shafts 71 are affixed by welding at their ends to the plates 26, 65, the bars or shafts 71 being disposed through suitable openings 72 through the respective plates at the lateral wing portions 68 and 69 of the plates 65 and at the correspondingly shaped portions of the plates 26. Oppositely disposed hydraulic cylinders 75 each have brackets 77 affixed to the ends thereof opposite the cylinder shafts, each bracket 77 having an opening therethrough through which one of the cylindrical bars or shafts 71 is disposed. The brackets 77 are disposed at the ends of the bars 71 in order that minimum strain will be imposed on the bars. The shafts 79 of cylinders 75 are cylindrical but are relieved at their opposite sides at end portions 80 to provide flatsided ends which are pivotally bolted by cross bolts 82 to the yoke-formed end 83 of a crank element 84. The crank elements 84 each have a circular central portion 85 and opposite outwardly reducing end portions 86. The yoke formations 83 are formed by cutting slots into the ends of the crank portions 86. Each crank 85 has a circular central opening 89 into which the end of a tubular shaft 44 is received and keyed against rotation by keys 90.

Simultaneous operation of the two cylinders 75 of each assembly 22, 22*a*, 22*b* causes rotation, in either direction, of the cranks 84 and the shafts 44 affixed thereto. This rotation of the cranks causes rotation of the discs 42, thereby moving the toggle elements 38 pivotally to extend or retract the slide elements 33 and the pipe engaging elements 10, 11 at the upper and lower sides of the apparatus.

A modified form of apparatus is shown in FIGS. 6 and 7 of the drawings. Plate 95 replaces plate 26, and plate 96 replaces plate 20. Plates 95, 96 are of circular form, being thicker at their inward portions 97, 98, respectively, and taperingly reducing at portions 99, 100 to be thinner at their peripheral outer portions 102, 103. Ring 30 of FIG. 3 is replaced by a similar ring 105 which is seated in recesses 106, 107 around the outer peripheries of the inner sides of plates 95, 96, respectively. Slide elements 110 are in the form of cylindrical bars, and have ball formations 111 at their inner ends. Annular grooves 110*a* and ports 110*b* are supplied with a suitable lubricant from ports (not shown) through ring 105. Ball formations 111 are received in sockets 112 formed in the outer ends of the toggles 114. In this embodiment, the toggles 114 are of cylindrical bar shape, modified at their ends. The lower end of each toggle is relieved at each side to form a flat plate formation 115 of the shape indicated in FIGS. 6 and 7. Each toggle is relieved at 117 to provide clearance with the adjacent toggle 116 and a curved relief 119 is provided at the opposite side of portion 115 of each toggle 114 to also provide clearance between adjacent toggles.

A cross pin 121 is disposed through ball shaped portion 111 at the lower end of each slide element 110. The pin 121 is disposed through holes 122 through the toggle at opposite sides of the sockets 112. The holes 122 are slightly elongated toward the inner ends of the toggles to enable ball portions 111 to seat fully in sockets 112. The ball-socket arrangement gives increased seating surface area between the slide elements 110 and the toggles 114 in order that increased load bearing capacity may be achieved. The cross pins 121 are not loaded, serving only to hold the connections in assembled condition.

Disc or hub 125, which substitutes for disc 42 of FIGS. 1–5 has a shaped recess 126 around its outer edge. The slot 126 has a series of adjacently formed recesses 127 the central portions of which are of the same arcuate forms as the lower ends of the toggles, at 129. The inner toggle ends seat flushly against the recess surfaces. Each recess is enlarged at 131 to enable pivotal movement of the toggle in the retracting direction.

Referring to FIG. 6, disc 125 is shown in the position in which the slide elements 110 are disposed inwardly and the pipe engagement elements 10 are retracted. Ring 105 is non-rotatable, and rotation of disc 125 in a counterclockwise direction, as it is shown in FIG. 6, causes retraction of the slide elements 110 and the pipe engaging elements 110. Rotation of disc 125 in a clockwise direction, as it is depicted in FIG. 6, moves the pivot pins 135 to in-line positions with elements 110, and causes outward axial movement of the slide elements 110 to expand the pipe engaging elements 10 and 11. The toggle elements 114 are moved from the angular position shown in FIG. 6 to positions substantially in-line with the slide elements 110 upon expansion of the pipe engaging elements, and the toggle elements 114 are moved from the in-line positions to the angular positions shown in FIG. 6 during retraction of the pipe engaging elements. Rotation of the disc 125 is caused in the same manner described in connection with FIGS. 1–5, the central shaft 44, around which disc 125 is concentrically fixed, being rotated by operation of fluid cylinders 75 to rotate crank 84 and shaft 44.

Pins 135 are diposed through openings in disc 125 at opposite sides of the recesses 127, the pins being disposed also through holes through the portions 115 of the inner ends of the toggles. The holes through the disc walls are elongated as indicated by dashed lines 135*a* to enable full seating of the toggle ends 129 in the recesses 127. It will be realized that the elongated holes may be provided in either member of a pair of connected members, in order to allow the freedom of movement for seating between the members.

Referring again to FIG. 1 of the drawings, a pair of rods 137, 138 are received through openings through the upper sides of the assemblies 21, 21*a*, 21*b*, the rods each being threaded at their opposite ends and having nuts 140 secured thereto. Spacer sleeves 137*a*, 137*b* and 138*a*, 138*b* are disposed around the rods to maintain proper spacings between the assemblies 21, 21*a*, 21*b*. Rod 137 and sleeves 137*a*, 137*b* are omitted from FIG. 1 in order to enable plates 65 to be completely shown. Rods 142, 143 are similarly disposed through suitable openings through the assemblies 21, 21*a*, 21*b*, at the bottom of the apparatus. Rods 142, 143 having spacer sleeves 142*a*, 142*b* and 143*a*, 143*b* therearound are externally threaded at their lefthand ends, as shown in FIG. 1, and two nuts 140 are secured thereto, one nut serving as a lock nut. The rods 142, 143 have washers 146 therearound at their righthand ends against which compression springs 147 bear, the other ends of the compression springs each bearing against a pair of nuts 140 at that end of the rod. The rods 137, 138 and 142, 143 stabilize the apparatus assembly. Compression springs 147 permit a small amount of lengthwise flexibility to the overall apparatus.

In FIG. 6 of the drawings, the toggles 114 are shown to be at angles of approximately thirty degrees to the slide elements 110 to which they are respectively connected, this being the retracted condiction of the apparatus. This angle may be of any suitable size. This description applies also to the toggle elements 38 of the FIG. 1–5 embodiment of the invention. When disc element 125 is rotated clockwise about its center to move the leftmost pin 135 to a position 135E in line with the axis of the leftmost slide element 110, the leftmost toggle element 114 will be moved to an outward expanded position 121E. These movements move the connected slide element 110 axially outward by the distance E, the pipe engaging element 10 (or 11) being moved outward by the same distance. All of the slide elements 110 are correspondingly moved outward by their respective toggles 114 and discs 125. The apparatus dimensions, with respect to the interior size of the pipe, are such that the required force is applied through the apparatus against the opposite sides of the pipe at the locations of the inner and outer radii of the bend to be made in the pipe. Theoretically, the force may approach infinity as the toggles approach the in-line positions. The actual force applied will depend on the force resistance of the pipe wall, and other factors, but the actual force may be made to be as large as necessary to suitably expand the pipe in the bend direction. The load capacity of the apparatus with regard to the additional very high loads which are imposed on the mandrel during bending of the pipe in a bending machine can be made entirely adequate, since the load forces are imposed against the slides, toggles, and disc surfaces seated flushly together, so that the load capacity does not depend on the strength of the pins 121 and 135 at the opposite ends of the toggle elements. In order that the apparatus will be "locked" in the expanded condition, the pin positions 135E may be slightly past the in-line positions. The apparatus is retracted after the bending operation has been completed by counterclockwise rotation of disc 125 (FIG. 6) and return of the toggle elements to their positions angular to radial shown in FIG. 6.

FIG. 8 indicates a modification which may be employed with either form of the apparatus according to the invention. Crank 84*a* is of generally triangular form, having three equally circularly spaced arm portions 86*a* each having a hole 82*a* for receiving a bolt 82 therethrough adjacent its outer end. Crank 84*a* is keyed to shaft 44 at 90. A crank of this form would be driven by three cylinders 75 disposed along dashed lines 75*a*, suitably supported by a modified plate assembly. In the same way, the apparatus may utilize only a single cylinder 75 or may use four or more cylinders 75.

The apparatus provided according to the invention is very simple and economical in use. The cylinders 75 are connected by suitable fluid conduits (not shown) to the hydraulic unit 13, from which they receive a suitable supply of hydraulic fluid for their operation. Suitable valve controls may be utilized for controlling the operation of the apparatus. Because of the metal-to-metal engagements of the toggles at each of their ends, the load capacity of the apparatus is extremely high as compared with older conventional apparatuses. Economy of both manufacture and operation is realized from the fact that no elongate power transmitting shaft or other similar power transmitting means is required for operation of the separate expansion-retraction assemblies. Each such assembly is self-driven separately of the other assemblies. The weight of the instant apparatus is considerably less than that of comparable mandrels of prior design. Because of the fact that the apparatus parts are readily accessible, field repairs may be accomplished readily and at low cost.

While preferred embodiments of the invention have been described and shown in the drawings, many modifications thereof may be made by a person skilled in the art without departing from the spirit of the invention, and it is intended to protect by Letters Patent all forms of the invention falling within the scope of the following claims.

I claim:

1. Internal pipe bending mandrel comprising a plurality of toggle means disposed spaced outwardly about an axis and being pivotally movable in planes transverse to said axis between retracted positions angular to radial and substantially radial extended positions, the outer ends of said toggle means each being pivotally connected to radially movable slide means each having outwardly facing means for engagement with the interior side of a pipe wall, said slide means and toggle means being disposed in plural axially spaced groups of circularly spaced slide means each having a toggle means connected thereto, separate means associated with each group of toggle means supported about said axis having plural radial openings through which said slide means are slidably disposed, the inner ends of said toggle means of each group thereof being pivotally connected to a separate rotative means rotatably disposed about said axis, each said rotative means having a peripheral slot into which said inner ends of said toggle means are disposed, said inner end of each said toggle means being arcuately rounded and said slot having concavely rounded surfaces for engaging said inner end of each said toggle means pin means engaged through an opening through the inner end of each said toggle means and through openings at opposite sides of said slot, one of said toggle opening and said slot openings being enlarged to permit movement of said inner end of the toggle means so that said inner end of the toggle means may bear flushly against said concavely rounded surface of said slot without imposition of force in the toggle direction against said pin means, and a separate drive means connected to each said rotative means capable of reciprocably rotating the rotative means in both rotative directions to simultaneously move said toggle means of a group thereof between said retracted and extended positions whereby said slide means of said group are simultaneously moved between radially inward retracted positions and radially outward extended positions wherein said outwardly facing means associated with said group may be forcefully engaged with the interior side of a pipe wall.

2. The combination of claim 1, said drive means comprising fluid actuated cylinder means.

3. The combination of claim 1, wherein said pivotal connections of said inner ends of said toggle means are equidistant from said axis, and wherein said pivotal connections of said outer ends of said toggle means are equidistant from said axis.

4. The combination of claim 1, wherein said toggle means are of substantially equal lengths, said wherein said slide means are of substantially equal lengths.

5. The combination of claim 1, wherein each said group comprises a plurality of said slide means circularly spaced at one side of said axis for disposition at the inside of the bend to be made in a pipe and a plurality of said slide elements circularly spaced at the other side of said axis for disposition at the outside of the bend to be made in the pipe.

6. The combination of claim 1, wherein each said rotative means comprises a disc concentric with said axis having said inner ends of said toggle means of a group thereof pivotally connected around its periphery, crank means connected transversely of said disc, said drive means being connected to reciprocably rotate said crank means to reciprocably rotate said disc to move said toggle means between said retracted and extended positions thereof.

7. The combinaton of claim 6, wherein said pivotal connection of said inner ends of said toggle to said discs are pinned connections the pin openings of which provide clearance for longitudinal movement of said inner ends of said toggle means against surfaces of said disc, and wherein said pivotal connections of said outer ends of said toggle means to said inner ends of said slide means are pinned ball and socket connections the pin openings of which provide clearance whereby said ball may fully seat in said socket, whereby when said toggle means and slide means are subjected to radial compressive load during pipe bending said load is not imposed on said pins.

8. The combination of claim 6, including rotative shaft means connecting said disc to said crank means.

9. The combination of claim 8, wherein the pivotal connection of said inner ends of said toggle to said discs are pinned connections the pin openings of which provide clearance for longitudinal movement of said inner ends of said toggle means against surfaces of said disc, and wherein said pivotal connections of said outer ends of said toggle means to said inner ends of said slide means are pinned ball and socket connections the pin openings of which provide clearance whereby said ball may fully seat in said socket, whereby when said toggle means and slide means are subjected to radial compressive load during pipe bending said load is not imposed on said pins.

10. The combination of claim 9, wherein said pivotal connections of said inner ends of said toggle means are equidistant from said axis, and wherein said pivotal connections of said outer ends of said toggle means are equidistant from said axis.

11. The combination of claim 9, wherein said toggle means are of substantially equal lengths, and wherein said slide means are of substantially equal lengths.

12. The combination of claim 9, wherein each said group comprises a plurality of said slide means circularly spaced at one side of said axis for disposition at the inside of the bend to be made in a pipe and a plurality of said slide elements circularly spaced at the other side of said axis for disposition at the outside of the bend to be made in the pipe.

13. The combination of claim 12, wherein said pivotal connections of said inner ends of said toggle means are equidistant from said axis, and wherein said pivotal connections of said outer ends of said toggle means are equidistant from said axis.

14. The combination of claim 12, wherein said toggle means are of substantially equal lengths, and wherein said slide means are of substantially euqal lengths.

* * * * *